US009276312B2

(12) United States Patent
Herrero et al.

(10) Patent No.: US 9,276,312 B2
(45) Date of Patent: Mar. 1, 2016

(54) ANTENNA TUNER CONTROL SYSTEM USING STATE TABLES

(71) Applicant: Intel Mobile Communications GmbH, Neubiberg (DE)

(72) Inventors: Pablo Herrero, Munich (DE); Andreas Langer, Lohhof (DE); Gunther Kraut, Egmating (DE); Grigory Itkin, Munich (DE); Jan-Erik Mueller, Ottobrunn (DE)

(73) Assignee: Intel Deutschland GmbH, Neubiberg (DE)

( * ) Notice: Subject to any disclaimer, the term of this patent is extended or adjusted under 35 U.S.C. 154(b) by 212 days.

(21) Appl. No.: 13/800,399

(22) Filed: Mar. 13, 2013

(65) Prior Publication Data

US 2014/0266965 A1 Sep. 18, 2014

(51) Int. Cl.

| | |
|---|---|
| ***H01Q 1/24*** | (2006.01) |
| ***H01Q 5/00*** | (2015.01) |
| ***H01Q 1/50*** | (2006.01) |
| ***H01Q 5/335*** | (2015.01) |

(52) U.S. Cl.

CPC ..... *H01Q 1/50* (2013.01); *H01Q 1/245* (2013.01); *H01Q 5/335* (2015.01)

(58) Field of Classification Search

CPC .... H04B 1/005; H04B 1/0053; H04B 1/0067; H04B 1/0458; H04B 17/103; H04B 17/14; H03H 11/30; H03H 17/0045

USPC ..... 343/702, 861

See application file for complete search history.

(56) References Cited

U.S. PATENT DOCUMENTS

| | | | | |
|---|---|---|---|---|
| 4,965,607 | A * | 10/1990 | Wilkins et al. | 343/861 |
| 5,874,921 | A | 2/1999 | Doherty et al. | |
| 6,392,610 | B1 * | 5/2002 | Braun | H01Q 1/243 343/700 MS |
| 6,980,782 | B1 * | 12/2005 | Braun | H01Q 1/242 455/121 |
| 7,088,967 | B2 | 8/2006 | Hildebrand et al. | |
| 7,176,841 | B2 * | 2/2007 | Fukuda | H01Q 1/242 343/745 |
| 7,991,363 | B2 * | 8/2011 | Greene | H03H 7/40 455/125 |
| 8,072,285 | B2 * | 12/2011 | Spears et al. | 333/17.3 |
| 8,131,232 | B2 | 3/2012 | Muhammad | |
| 8,170,505 | B2 | 5/2012 | Keerti et al. | |
| 8,170,509 | B2 | 5/2012 | Norris et al. | |
| 8,311,495 | B2 | 11/2012 | Norris et al. | |
| 8,655,286 | B2 * | 2/2014 | Mendolia | H04B 1/0458 455/69 |
| 8,860,525 | B2 * | 10/2014 | Manssen | H03H 7/40 333/17.3 |
| 2002/0123363 | A1 | 9/2002 | Hildebrand et al. | |

(Continued)

FOREIGN PATENT DOCUMENTS

WO 2009124874 A1 10/2009

OTHER PUBLICATIONS

Notice of Allowance dated Jul. 31, 2013 for U.S. Appl. No. 13/273,563.

Qizheng Gu, et al.; "An Analytical Algorithm for Pi-Network Impedance Tuners"; IEEE; 2011; p. 1-12.

U.S. Appl. No. 13/081,694, filed Apr. 7, 2011.

(Continued)

*Primary Examiner* — Robert Karacsony
*Assistant Examiner* — Patrick Holecek
(74) *Attorney, Agent, or Firm* — Eschweiler & Associates, LLC

(57) ABSTRACT

An antenna tuner control system includes an RF path, a lookup table and a state table analysis component. The RF path is configured to generate an RF signal. The lookup table has a state table that correlates antenna states with impedance values. The state table analysis component is configured to generate a tuner control signal from the RF signal using the lookup table.

20 Claims, 6 Drawing Sheets

(56) References Cited

U.S. PATENT DOCUMENTS

| | | | | |
|---|---|---|---|---|
| 2005/0245204 | A1* | 11/2005 | Vance | 455/80 |
| 2006/0025088 | A1 | 2/2006 | Pietig et al. | |
| 2009/0253385 | A1 | 10/2009 | Dent et al. | |
| 2011/0254751 | A1* | 10/2011 | Bengtsson | H03H 7/40 343/860 |

OTHER PUBLICATIONS

Notice of allowance dated Jan. 28, 2013 for U.S. Appl. No. 13/081,694.

Office Action dated Mar. 6, 2013 for U.S. Appl. No. 13/273,563.

U.S. Appl. No. 13/273,563, filed Oct. 14, 2011.

Office Action dated Sep. 19, 2012 for U.S. Appl. No. 13/081,694.

* cited by examiner

200

300

ANTENNA TUNER CONTROL SYSTEM USING STATE TABLES

BACKGROUND

Modern communication units/phones include integrated antennas to transmit and receive radio frequency (RF) signals. Designers attempt to make these integrated antennas smaller and smaller, while at the same time covering as many frequency bands as possible. The small size allows the integrated antennas to be used in different types of end-user devices, while the wide operating frequency allows a given end user device to be used for different communication standards.

However, these integrated antennas are sensitive to external factors or use. This sensitivity to external factors, combined with the fact that a given antenna can be used over multiple frequency bands, makes it difficult to accurately match the impedance of the antenna to the impedance of the RF circuitry in the transmitter. Some examples of external factors that can impact impedance of an integrated antenna include; whether or not a hand is positioned on the phone (and the particular position of such a hand, if present), whether the phone is close to a user's head, and/or whether any metal objects are close to the antenna, among others. These variations in impedance from the external factors lead to impedance mismatch between the antenna and RF circuitry within the transmitter. Such impedance mismatch can degrade the power radiated by the phone and increase the phone's sensitivity to noise. From a user's perspective, impedance mismatch can ultimately lead to a reduction in talk time and/or a dropped call.

One technique to facilitate impedance matching between RF circuitry in the transmitter and the antenna is to use antenna tuners. In one example, sensors are arranged inside a phone's package to detect the presence or absence of the external factors. Then the detected environment is compared with known use cases (e.g., "free space", "hand on the phone", "close to head", "metal plate" . . . ) and a corresponding predetermined tuner setting is chosen selected based on the detected use case.

Unfortunately, this conventional approach requires a large number of sensors inside the mobile phone, which increases the phone's volume and cost (particularly if there are a large number of possible use cases to be detected). For example, with regards to a "hand on the phone" use case, sensors may be needed to differentiate between "Man's hand . . . ", "Woman's hand . . . ", "Child's hand . . . ", and to further differentiate each of these hand types as having "dry skin . . . ", "normal skin", "sweaty skin", etc. Sensors might also be needed to detect a mobile phone's package and even its color, some of which can be changed via aftermarket accessories and which can affect impedance matching for the antenna. Further, because the tuner settings for each use case are dependent on frequency bands (and even frequency sub bands), the conventional approach requires a detailed analysis of use cases in a dynamic fashion for each new handset design. Having to analyze and store all of these use cases requires a large number of sensors, a significant amount of ROM, and processing power.

Therefore, conventional antenna matching schemes are deficient and more efficient techniques are needed.

DETAILED DESCRIPTION

Figure 1:
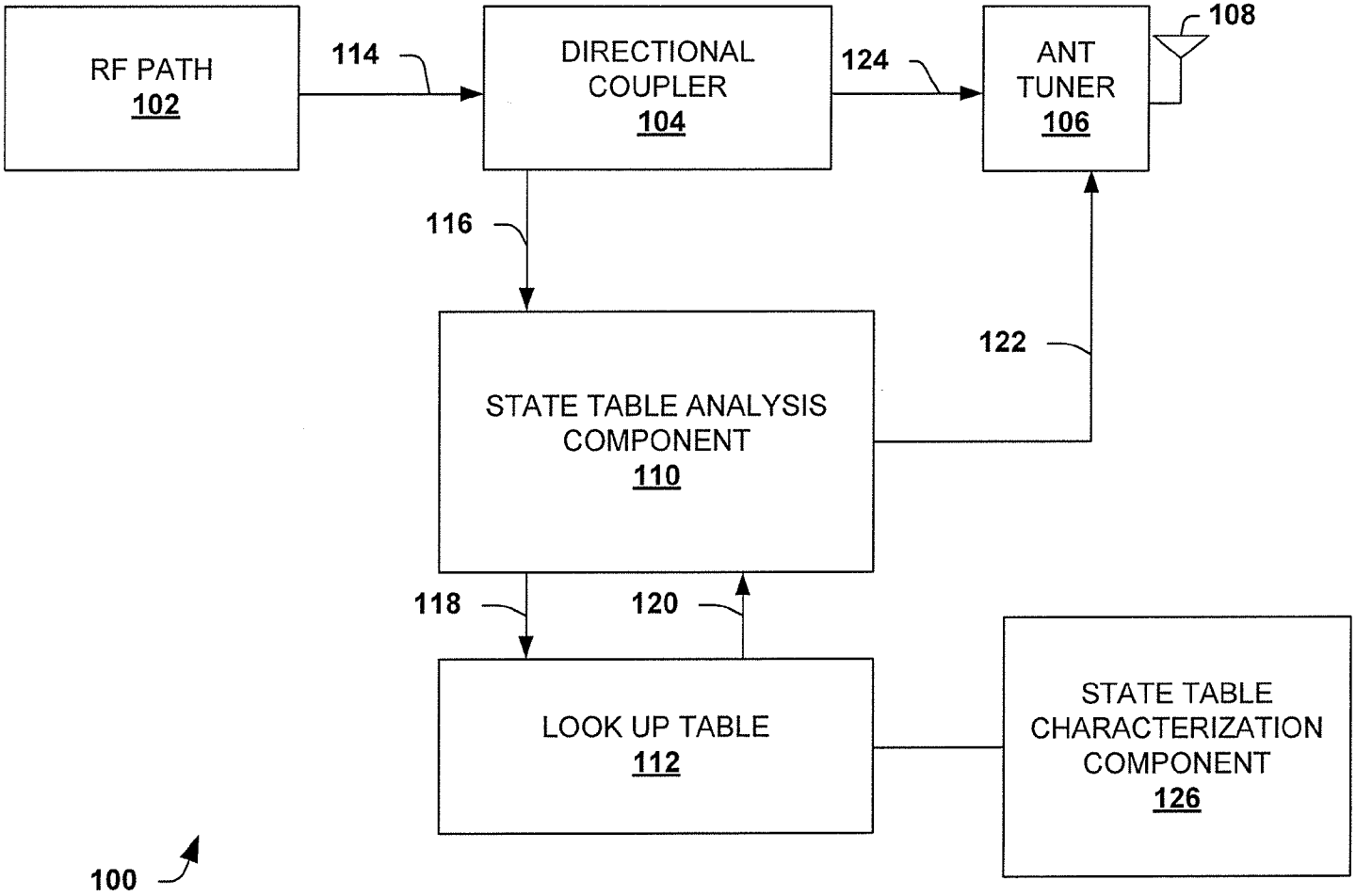
FIG. 1 is a block diagram illustrating an antenna tuner control system using state tables.

The present invention will now be described with reference to the attached drawing figures, wherein like reference numerals are used to refer to like elements throughout, and wherein the illustrated structures and devices are not necessarily drawn to scale.

Systems and methods are disclosed that provide self adaptive antenna tuner control based on state tables.

FIG. 1 is a block diagram illustrating an antenna tuner control system 100 using state tables. The system 100 utilizes impedance values for various states within a lookup table in order to provide antenna impedance control.

The system 100 may be utilized in a mobile communication device, such as a cell phone. Such devices are subjected to varied use conditions, such as a "hand on the phone", "Man's hand . . . ", "Woman's hand . . . ", "Child's hand . . . ", "dry skin . . . ", "normal skin", "sweaty skin", and the like. These use conditions can vary impedance values of an integrated antenna. The system 100 can be utilized to match the antenna impedance with the transmission path or the RF path, which is referred to as impedance matching.

The system 100 includes an RF path 102, a directional coupler 104, an antenna tuner 106, a state table analysis component 110, and a look up table 112. The RF path 102 generates an RF signal 114 to be transmitted over an RF antenna 108 while the transmitter is subject to one or more states and use conditions.

The directional coupler 104 is coupled between the RF path 102 and the antenna tuner 106. The directional coupler 104 obtains a small part of the RF signal 114 and/or a reflected signal from an antenna path 108 and provides the small part as a coupled signal 116. A remaining signal 124 is provided to the antenna tuner 106.

The antenna tuner 106 receives the remaining signal 124 and may provide the signal 124 to an antenna 108 for transmission. The antenna tuner 106 is configured to adjust or alter antenna impedance according to a received control signal 122. The control signal 122 indicates a desired impedance adjustment, which facilitates impedance matching. In one example, the control signal 122 is a matching impedance value. In another example, the control signal 122 includes capacitance adjustments for adjustable capacitors within the antenna tuner 106.

The look up table 112 includes a series of entries. Each entry includes a domain or translated impedance (typically a range of impedances) and an antenna state. Entries are referenced by a measured and translated impedance value (Zin) 118. The look up table 112 provides the matching antenna state 120 according to the impedance value 118. The look up table 112 may be implemented in SRAM, such as a transceiver's SRAM, or another suitable storage mechanism. Entries may be created using a characterization technique, such as described below.

The look up table 112 can include one or more tables based on frequency. Each table may be referred to as a state table and includes impedance ranges paired with antenna states for a particular frequency or frequency range. For example, one table of entries could correlate to a mid band frequency. The multiple tables is based on the frequency response.

In one example, the look up table 112 has values that are rotated according to selected frequencies. In this manner, generation of multiple tables can be omitted.

The state table analysis component 110 receives the coupled signal 116 from the directional coupler 104. The analysis component 110 measures an impedance using the coupled signal 116. The measured impedance is translated using a reference state, which was used to generate the state table.

The translated impedance value 118 is provided to the look up table 112 as described above. In response, the current antenna state 120 is received. The analysis component 110 estimates a matching impedance from the antenna state 120 and the measured impedance. The estimated matching impedance is used to generate the control signal 122. In one example, the estimated matching impedance is utilized to generate capacitance values for the antenna tuner 106.

An external component, a state table characterization component 126, generates the lookup table 112 using a characterization technique. The characterization technique utilizes a reference state to generate the table 112. The table 112 may be generated in a lab or other environment prior to normal use of the mobile communication device. In this example, the characterization component 126 is external to the system 100.

It is noted that adjustments to the impedance are made in a relatively simple manner compared with conventional techniques for matching impedance. The state table analysis component 110 merely accesses the lookup table 112 to obtain the needed state information. As a result, over the air testing is not required, feedback receiver accuracy is less important, and additional or improved antenna sates can be identified.

Figure 2:
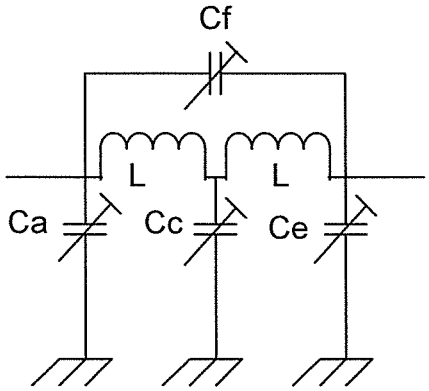
FIG. 2 is a circuit diagram illustrating an example antenna tuner circuit.

FIG. 2 is a circuit diagram illustrating an example antenna tuner circuit 200. It is appreciated that the antenna tuner circuit 200 is merely one example provided for purposes of understanding and in no way limits the scope of the present invention. The antenna tuner 200 includes first and second inductors arranged in series, wherein each inductor has first and second terminals. Adjustable capacitors can also be coupled as shown. A control signal, such as the control signal 122 of FIG. 1, can alter the capacitance values to "tune" the antenna tuner 200 so as to match the input impedance of the RF antenna 108 with the output impedance of the RF path 102.

Figure 3:
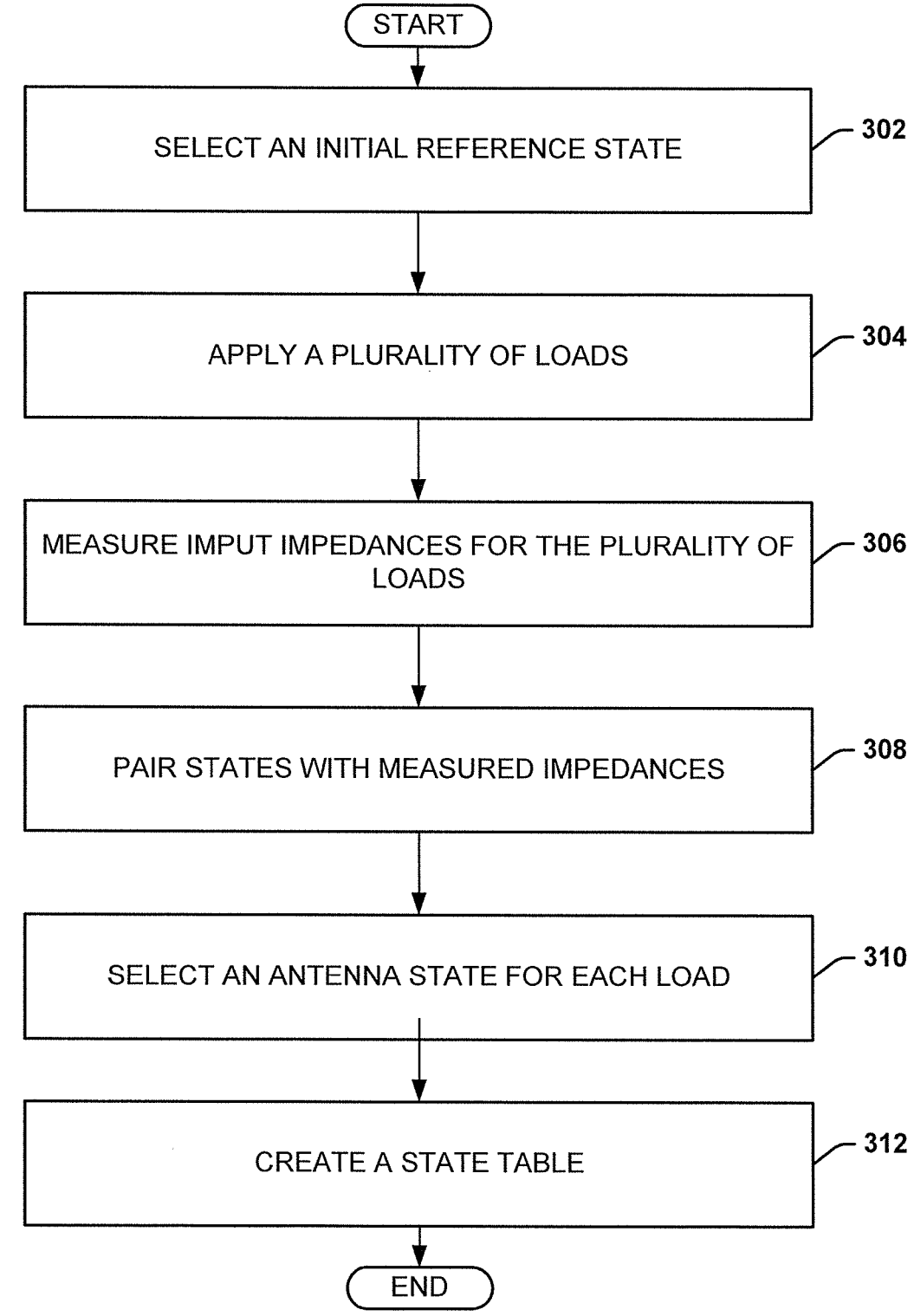
FIG. 3 is a flow diagram illustrating a method of characterizing a communication device/system and generating a state table.

FIG. 3 is a flow diagram illustrating a method 300 of characterizing a communication device/system and generating a state table. The characterization can be implemented in hardware and/or software.

The method 300 begins at block 302, wherein a reference state is selected. The reference state may be selected according to yield selected characteristics. For example, the reference state may be selected to mitigate insertion loss for predefined conditions, such as an insertion loss of 50 ohm, for predefined loading conditions, frequency, and/or the like. It is appreciated that there may be more than one reference state and the device can be characterized these additional reference states as well.

A plurality of loads are applied to the communication device for the reference state at block 304. One example of applying the loads is to perform a load pull where possible impedances in a smith chart are swept at an output of an antenna tuner of the communication device. An example load pull technique is to sweep 7 voltage standing wave ratio (VSWR) circles or magnitudes with a 10 degree phase granularity.

Block 304 is described for a single reference state, however it is appreciated that the block can be repeated for other reference states.

Input impedances are measured and stored for the plurality of loads at block 306. The impedances are measured using a suitable technique, such as using a vector network analyzer (VNA). The impedances are typically measured for one or more load pulls. As a result, one or more impedance measurements are stored for the reference state. The impedances are stored with a suitable mechanism, such as a memory device, SRAM, software package, and the like. The measured impedances are for a translated domain, which is the S11 of the antenna tuner plus load condition for the reference state.

The reference state(s) are paired with measured impedances at block 308. Multiple states can be associated with single load pull conditions.

A single or antenna state is selected for each load or load pull condition according to selection criteria at block 310. The selection criteria includes, for example, a relative transducer gain (RTG), insertion loss, and the like. In one example, the state is selected that yields the highest RTG. In another example, the state is selected that yields the lowest insertion loss (lowest S11).

A smith chart or similar mechanism can be utilized to select states for each load, also referred to as a domain impedance. An additional description on utilizing a smith chart to select states is described below.

A state table or lookup table is created at block 312. The state table can be stored in a memory device, such as SRAM. The state table has a plurality of entries. Each entry includes a translated or domain impedance and a corresponding state, also referred to as an antenna state. The translated impedance is based on the reference state used in characterizing the device. The translated domain impedance is a measured impedance before an antenna tuner with a feedback receiver while the device is in the reference state. The translated domain impedance is passed through a reference state in order to decode or obtain the non-translated or actual impedance.

Variations in the method 300 are contemplated. For example, the method 300 can be repeated for different frequency points, such as edges and middle of a frequency band.

Figure 4:
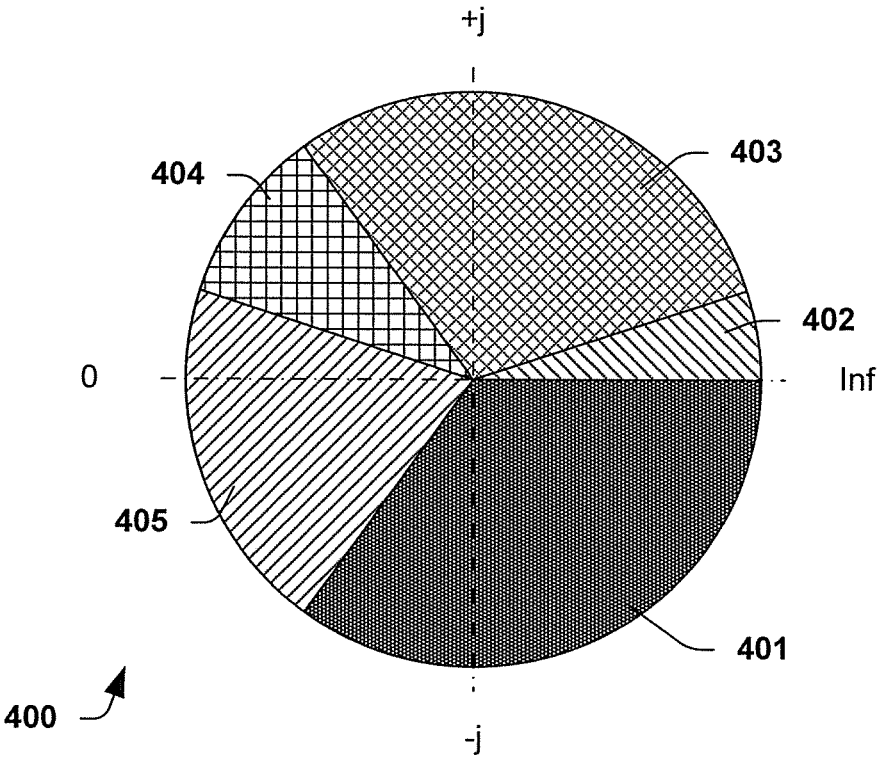
FIG. 4 is an example of a smith diagram arrangement that can be utilized to correlate domain impedances with antenna/reference states.

FIG. 4 is an example of a smith diagram arrangement 400 that can be utilized to correlate translated domain impedances with antenna/reference states. The arrangements is provided as an example for illustrative purposes.

The arrangement is shown with 5 sectors, which may also represent antenna impedances. The sectors are shown with "pie" shapes, however it is appreciated that the impedance may appear in other shapes for the sectors. The sectors can be predetermined or refined for a particular architecture. Additionally, the number of sectors can also be predefined.

Here, the arrangement 400 has a first sector 401, a second sector 402, a third sector 403, a fourth sector 404, and a fifth sector 405. The area occupied by each sector can vary. Some sectors can be combined with other sectors. For example, the second sector 402 is relatively small and may be combined with the first sector 401 and/or the third sector 403 in order to simplify the number of states or sectors.

Figure 5:
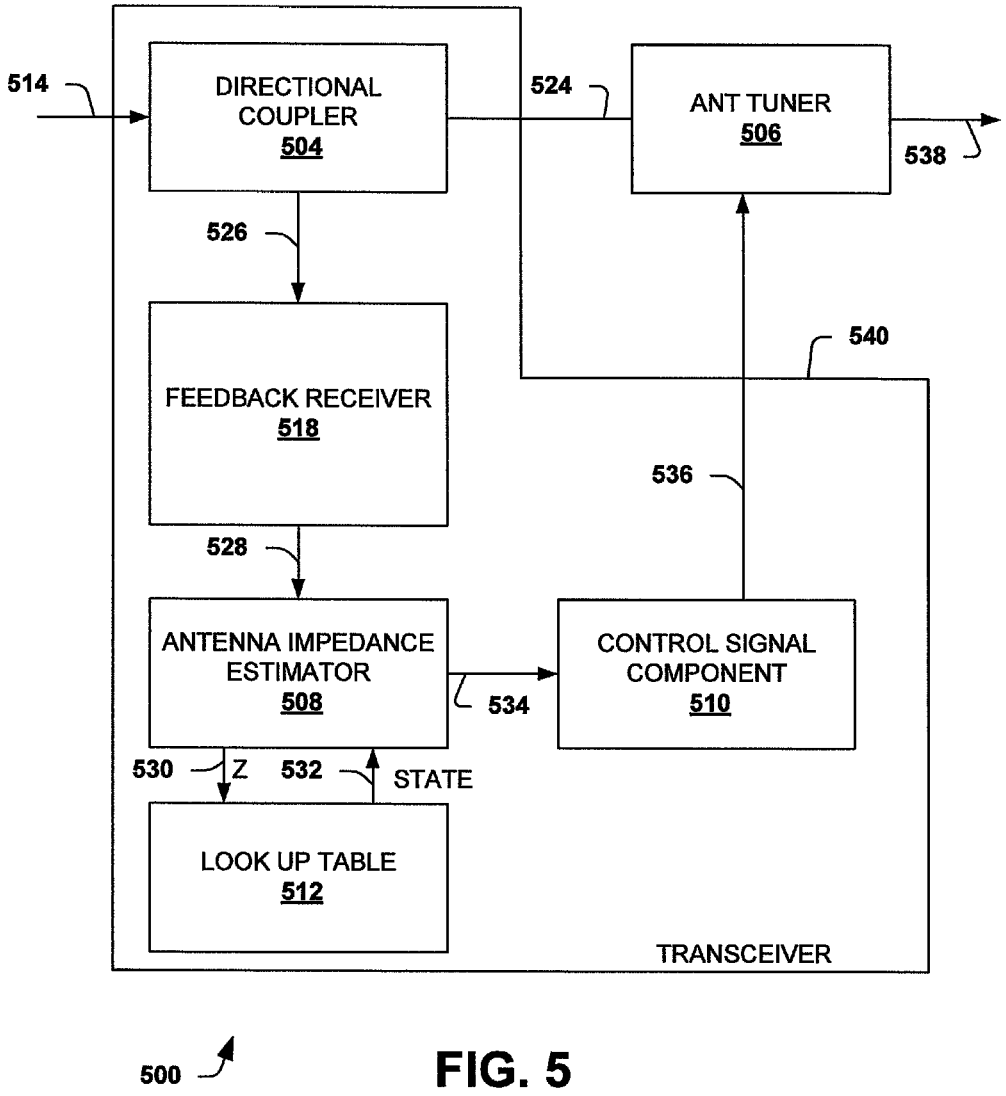
FIG. 5 is a block diagram illustrating an antenna tuner adjustment system.

FIG. 5 is a block diagram illustrating an antenna tuner adjustment system 500. The system 500 utilizes information stored in a state table to efficiently implement impedance matching.

The system 500 includes a portion of a transceiver 540 and an antenna tuner 506. The transceiver 540 receives an RF signal 514 and provides a remaining signal 524. The transceiver 540 may include or be a portion of an analysis component, such as the analysis component 110 of FIG. 1. The antenna tuner 506 receives the remaining signal 524 and provides an output signal 538, suitable for transmission. The antenna tuner 506 also receives a control signal 536, which is utilized to adjust impedance and facilitate impedance matching.

The transceiver portion 540 includes a directional coupler 504, a feedback receiver 518, an antenna impedance estimator 508, a lookup table 512 and a control signal component 510. The directional coupler 504 obtains a small part of the RF signal 514. The coupler 504 may also obtain a feedback or reflected signal from the antenna tuner 506. The coupler 504 provides the coupled or obtained signals as a coupled signal 526.

The lookup table 512 includes a state table that correlates translated impedance values with antenna states. The translated impedance values are based on a reference state, which is utilized in generation of the state table. The state table includes entries having a range of impedance values and a corresponding antenna state. An example of generating a state table is provided above.

The feedback receiver 518 measures an impedance (Zin) of the coupled signal. A suitable technique to measure the impedance is utilized. The impedance (Zin) varies according to use conditions. For example, the current state impedance will have different values depending on whether a mobile device is in a users hand, or held by their head, and the like. The current state or use typically varies over time, thus the current state may vary from a previous state.

The antenna impedance estimator 508 receives the measured impedance and generates an impedance offset adjustment 534. The impedance estimator 508 uses the reference state to translate the measured impedance 528 into a translated impedance 530. The antenna impedance estimator 508 uses the translated impedance 530 to reference the lookup table 512. As stated above, the lookup table 512 includes the state table. The lookup table 512 identifies a matching state from the translated impedance 530 and returns a matching antenna state 532.

The impedance estimator 518 uses the matching state 532 and the measured impedance 528 to generate the impedance offset adjustment 534. This value represents a change in impedance for the antenna tuner 506 that facilitates impedance matching between the antenna tuner and the transceiver and transmission path.

The control signal component 510 receives the impedance offset adjustment 534 and generates the control signal 536. The control signal 536 configures the antenna tuner 506 for the matching state 532. The control signal 536 conveys information needed to improve or facilitate impedance matching. The component 510 may generate the control signal 536 using one or more suitable techniques. In one example, the control signal 536 is generated to provide capacitance values for the antenna tuner 506. The provided capacitance values yield the impedance offset adjustment.

The control signal 536 can be provided to the antenna tuner 506 using a suitable interface. In one example, a radio frequency front end control interface (RFFE) is utilized.

The system 500 facilitates communications by improving and simplifying impedance matching. It is appreciated that variations in the system 500 are contemplated.

Figure 6:
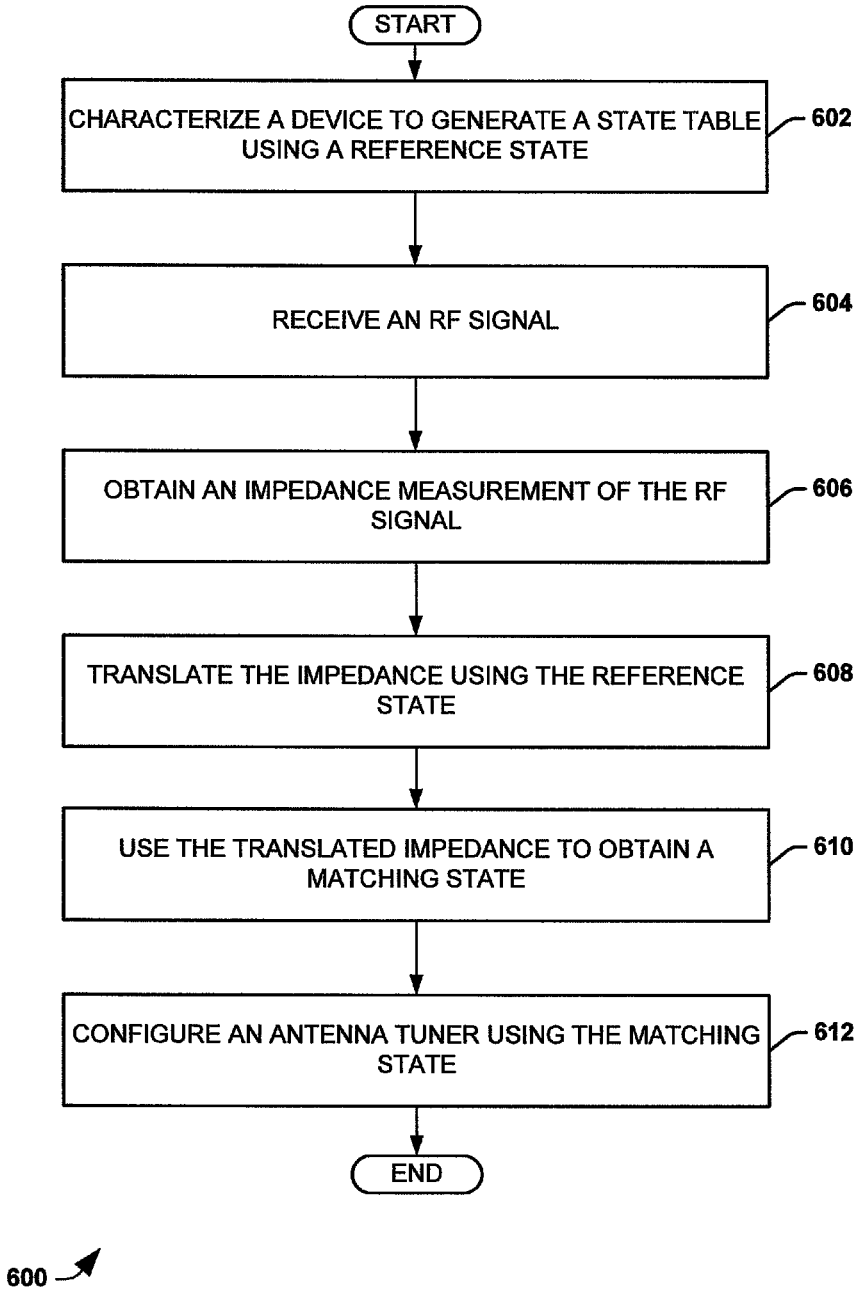
FIG. 6 is a flow diagram illustrating a method of generating a control signal for an antenna tuner.

FIG. 6 is a flow diagram illustrating a method 600 of generating a control signal for an antenna tuner. The control signal can be used by the antenna tuner to tune an antenna and facilitate matching impedance with a transmission path of a transceiver. The above systems and variations thereof can be referenced to facilitate understanding.

The method 600 begins at block 602, wherein a state table is generated by characterizing a device using a reference state. The device can include mobile devices, communication devices, and the like. The table is created off line by simulating or subjecting the device to varied use conditions. Impedances are measured and a number or plurality of antenna states are developed. The impedances are correlated or paired with the antenna states and form the state table. The method 300, described above, illustrates a suitable technique to generate the state table.

It is noted that once the state table is generated, it does not need to be recreated during use of the device.

An RF signal is received at block 604. The RF signal is generated by an RF transmission path, such as the path described above. The RF signal typically includes information to be transmitted.

An impedance measurement of the RF signal is obtained at block 606. The impedance measurement typically represents current conditions of the RF transmission path. The measurement may be obtained by obtaining a coupled signal from the RF signal and utilizing a feedback receiver to measure the impedance. The coupled signal can also include a reflected transmission signal.

The measured impedance is translated using the reference state to obtain a translated impedance at block 608. The reference state is the state used in characterizing the device at block 602.

The translated impedance is used to obtain a current or matching state of the RF transmission path at block 610. The state table is referenced with the translated impedance to obtain the matching antenna state. Generation of the state table is described above.

In one variation, the measured impedance is compared to a previous measured impedance. If the comparison is relatively small, a neighbor state can be applied to the antenna tuner.

The matching antenna state is utilized to configure an antenna tuner at block 612. The antenna tuner is configured using a suitable mechanism. In one example, the antenna tuner is configured by using the matching state to develop an impedance offset amount. Capacitance values or changes are calculated from the impedance offset amount. The capacitance values are then provided to the antenna tuner as a configuration or control signal.

While the methods provided herein are illustrated and described as a series of acts or events, the present disclosure is not limited by the illustrated ordering of such acts or events. For example, some acts may occur in different orders and/or concurrently with other acts or events apart from those illustrated and/or described herein. In addition, not all illustrated acts are required and the waveform shapes are merely illustrative and other waveforms may vary significantly from those illustrated. Further, one or more of the acts depicted herein may be carried out in one or more separate acts or phases.

It is noted that the claimed subject matter may be implemented as a method, apparatus, or article of manufacture using standard programming and/or engineering techniques to produce software, firmware, hardware, or any combination thereof to control a computer to implement the disclosed subject matter (e.g., the systems shown above, are non-limiting examples of circuits that may be used to implement disclosed methods and/or variations thereof). The term "article of manufacture" as used herein is intended to encompass a computer program accessible from any computer-readable device, carrier, or media. Those skilled in the art will recognize many modifications may be made to this configuration without departing from the scope or spirit of the disclosed subject matter.

An antenna tuner control system includes an RF path, a lookup table and a state table analysis component. The RF path is configured to generate an RF signal. The lookup table has a state table that correlates antenna states with impedance values. The state table analysis component is configured to generate a tuner control signal from the RF signal using the lookup table.

An antenna tuner system includes a directional coupler, a feedback receiver, a lookup table, and an antenna impedance estimator. The directional coupler is configured to receive an RF signal and to generate a coupled signal. The directional coupler passes a remaining signal from the RF signal. The feedback receiver is configured to measure an impedance of or from the coupled signal. The lookup table is configured to provide a matching antenna state in response to an input impedance. The antenna impedance estimator is configured to generate an impedance offset amount from the measured impedance and the matching antenna state. The control signal component is configured to generate a control signal in response to the impedance offset amount. The control signal can be provided to an antenna tuner to facilitate impedance matching.

A method of generating a control signal for an antenna tuner is disclosed. An impedance of an RF signal is measured. A matching antenna tuner state is obtained by referencing a state table with the measured impedance. An antenna tuner is configured using the matching antenna tuner state.

Although the invention has been illustrated and described with respect to one or more implementations, alterations and/or modifications may be made to the illustrated examples without departing from the spirit and scope of the appended claims. For example, although a transmission circuit/system described herein may have been illustrated as a transmitter circuit, one of ordinary skill in the art will appreciate that the invention provided herein may be applied to transceiver circuits as well. Furthermore, in particular regard to the various functions performed by the above described components or structures (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "including", "includes", "having", "has", "with", or variants thereof are used in either the detailed description and the claims, such terms are intended to be inclusive in a manner similar to the term "comprising".

What is claimed is:

1. An antenna tuner control system comprising:

an RF path configured to generate an RF signal;

a lookup table having a state table correlating a plurality of antenna states with impedance values; and a state table analysis component configured to measure an impedance of the RF signal, reference the lookup table based on the measured impedance, obtain an antenna state of the plurality of antenna states, estimate, in response to obtaining the antenna state from the lookup table, a matching impedance from the antenna state and the measured impedance, and generate a tuner control signal based on the matching impedance.

2. The system of claim 1, further comprising an antenna path having an antenna path impedance that varies according to use conditions and wherein the use conditions correlate to the antenna state.

3. The system of claim 2, wherein the use conditions include proximity of hand to a mobile device.

4. The system of claim 1, wherein the state table analysis component is configured to measure an impedance of the RF signal using a coupled version of the RF signal.

5. The system of claim 1, wherein the state table analysis component is further configured to utilize the measured impedance and a reference state to generate a translated impedance and the translated impedance is used to identify the antenna state from the state table, perform a comparison of the measured impedance with a previous measured impedance, and, in response to the comparison, applying a neighbor state of the plurality of antenna states to the antenna tuner.

6. The system of claim 1, wherein the tuner control signal includes capacitance values.

7. The system of claim 1, wherein the tuner control signal corresponds to an impedance offset amount.

8. The system of claim 1, further comprising an antenna tuner configured to receive the tuner control signal.

9. The system of claim 8, wherein the antenna tuner adjusts an antenna impedance to match an impedance of the RF path according to the tuner control signal.

10. The system of claim 1, wherein the state table corresponds to a first frequency and the lookup table includes a second state table corresponding to a second frequency, wherein the second frequency is varied from the first frequency.

11. The system of claim 1, wherein the analysis component includes a feedback receiver and a directional coupler, wherein the coupler obtains a coupled signal from the RF signal and the feedback receiver is configured to measure an impedance from the coupled signal.

12. The system of claim 11, wherein the coupled signal includes a reflected signal from an antenna path.

13. The system of claim 1, wherein the state table includes entries, wherein each entry includes an antenna state and a corresponding range of impedance values.

14. An antenna tuner system comprising:

a directional coupler configured to generate a coupled signal;

a feedback receiver configured to measure an impedance from the coupled signal;

a lookup table having a plurality of antenna states configured to provide a antenna state from the plurality of antenna states based on the measured impedance;

an antenna impedance estimator configured to obtain the antenna state from the lookup table using the measured impedance and a reference state, estimate, in response to obtaining the antenna state, a matching impedance from the antenna state and the measured impedance, and to generate an impedance offset amount from the antenna state, wherein the impedance offset amount is a change in impedance for an antenna tuner to provide impedance matching between the antenna tuner and a transmission path; and a control signal component configured to generate a control signal in response to the impedance offset amount.

15. The system of claim 14, wherein the directional coupler is further configured to use a reflected signal and an RF signal to generate the coupled signal.

16. The system of claim 14, further comprising an antenna tuner configured to receive a remaining signal from the directional coupler and the control signal and the antenna tuner configured to generate an output signal corresponding to the antenna state.

17. A method of generating a control signal for an antenna tuner, the method comprising:

measuring an impedance of a signal;

translating the measured impedance using a reference state into a translated impedance;

referencing a state table having a plurality of antenna states correlated with the translated impedance to obtain an antenna state;

developing an antenna tuner impedance offset amount based on the antenna state;

estimate, in response to obtaining the antenna state, a matching impedance from the antenna state and the measured impedance; and configuring an antenna tuner using the antenna tuner impedance offset amount to provide impedance matching with a transmission path.

18. The method of claim 17, further generating the state table by characterizing a device.

19. The method of claim 18, wherein characterizing the device comprises:

applying a plurality of load pulls for a reference state;

measuring impedance values for the plurality of load pulls;

pairing antenna states with the measured impedance values; and creating the state table using the pairings.

20. The method of claim 17, further comprising:

performing a comparison of the measured impedance with a previous measured impedance; and in response to the comparison, applying a neighbor state of the plurality of antenna states to the antenna tuner.

* * * * *